US010438607B2

(12) United States Patent
Geng

(10) Patent No.: US 10,438,607 B2
(45) Date of Patent: Oct. 8, 2019

(54) DEVICE AND METHOD FOR CANCELLING ECHO

(71) Applicant: BEIJING BAIDU NETCOM SCIENCE AND TECHNOLOGY CO., LTD., Beijing (CN)

(72) Inventor: Lei Geng, Beijing (CN)

(73) Assignee: BEIJING BAIDU NETCOM SCIENCE AND TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 16/207,005

(22) Filed: Nov. 30, 2018

(65) Prior Publication Data

US 2019/0244628 A1 Aug. 8, 2019

(30) Foreign Application Priority Data

Feb. 5, 2018 (CN) ..... 2018 1 0114239

(51) Int. Cl.

| | |
|---|---|
| ***G10L 21/02*** | (2013.01) |
| ***H04R 3/00*** | (2006.01) |
| ***G10L 21/0232*** | (2013.01) |
| ***H04R 1/32*** | (2006.01) |
| *G10L 21/0208* | (2013.01) |

(52) U.S. Cl.

CPC ..... *G10L 21/0232* (2013.01); *H04R 1/326* (2013.01); *G10L 2021/02082* (2013.01)

(58) Field of Classification Search

CPC . H04R 3/00; H04R 3/005; H04R 3/04; H04R 3/12; H04R 1/326; H04R 1/1083; H04R 2410/05; H04R 29/00; G10L 21/02; G10L 21/0216; G10L 21/0232; G10L 2021/0208; G10L 2021/02082; G10L 2021/02163

See application file for complete search history.

(56) References Cited

U.S. PATENT DOCUMENTS

| | | | | |
|---|---|---|---|---|
| 2006/0182291 | A1* | 8/2006 | Kunieda | G10L 15/00 381/110 |
| 2006/0245584 | A1* | 11/2006 | Otani | H04M 1/60 379/406.08 |
| 2007/0160221 | A1* | 7/2007 | Pfaffinger | H04R 29/001 381/59 |
| 2010/0002866 | A1* | 1/2010 | Ozawa | H04M 9/082 379/406.06 |

(Continued)

*Primary Examiner* — Thang V Tran

(74) *Attorney, Agent, or Firm* — Lathrop Gage LLP

(57) ABSTRACT

Embodiments of the present disclosure provide a method and a device for cancelling an echo, and a computer readable storage medium. The device includes a loudspeaker configured to play an acoustic signal corresponding to an analog audio signal. The device further includes a microphone configured to convert a mixed acoustic signal received into a mixed audio signal. The mixed acoustic signal includes an echo of the acoustic signal played and an acoustic signal from a user. The device further includes an analog-to-digital converter configured to convert the analog audio signal into a digital signal as an echo reference signal. The device further includes an echo canceller, configured to cancel an echo component from the mixed audio signal using the echo reference signal to obtain a user audio signal corresponding to the acoustic signal from the user.

18 Claims, 4 Drawing Sheets

(56) References Cited

U.S. PATENT DOCUMENTS

| | | | | |
|---|---|---|---|---|
| 2010/0029345 | A1* | 2/2010 | Seydoux | H04M 9/082 455/569.2 |
| 2010/0166199 | A1* | 7/2010 | Seydoux | H04M 9/082 381/66 |
| 2011/0002458 | A1* | 1/2011 | Czyzewski | H04B 3/234 379/406.06 |
| 2011/0087341 | A1* | 4/2011 | Pfaffinger | H04R 29/001 700/30 |
| 2011/0181452 | A1* | 7/2011 | Raifel | H04R 3/02 341/110 |
| 2016/0019907 | A1* | 1/2016 | Buck | H04M 9/082 704/226 |
| 2016/0358602 | A1* | 12/2016 | Krishnaswamy | G10L 15/20 |
| 2017/0310360 | A1* | 10/2017 | Gejo | H04B 3/237 |
| 2018/0122357 | A1* | 5/2018 | Thornock | G10K 11/178 |

* cited by examiner

DEVICE AND METHOD FOR CANCELLING ECHO

CROSS REFERENCE TO RELATED APPLICATION

This application claims priority to Chinese Patent Application No. 201810114239.X, filed on Feb. 5, 2018, the entire contents of which are incorporated herein by reference.

TECHNICAL FIELD

Embodiments of the present disclosure generally relate to voice interactions, and more particular to a method and a device for cancelling echo and a computer readable storage medium.

BACKGROUND

In recent years, with the rapid development of voice technology and the rapid spread of intelligent voice hardware devices, users' demand on voice interaction is increasing. In voice interaction, keyword wake-up function and voice interruption function are essential to the voice interaction, and echo cancellation is required to implement these functions. In general, echo refers to sound made by a voice interaction device itself. For example, when a smart speaker is playing music, the user can interrupt the music and perform voice control operation. At this time, the music being played and the sound emitted by the user are actually collected by the microphone array of the smart speaker.

SUMMARY

Embodiments of the present disclosure relates to a method for cancelling an echo, a device for cancelling an echo and a computer readable storage medium.

The present disclosure provides an electronic device. The electronic device includes a loudspeaker which is configured to play an acoustic signal corresponding to an analog audio signal. The electronic device further includes a microphone which is configured to convert a mixed acoustic signal received into a mixed audio signal. The mixed acoustic signal includes an echo of the acoustic signal played and an acoustic signal from a user. The electronic device further includes an analog-to-digital convertor which is configured to convert the analog audio signal into a digital signal as an echo reference signal. The electronic device further includes an echo canceller which is configured to cancel an echo component from the mixed audio signal using the echo reference signal to obtain a user audio signal corresponding to the acoustic signal from the user.

The present disclosure provides a method for cancelling an echo. The method includes enabling an acoustic signal corresponding to an analog audio signal to be played via a loudspeaker of an electronic device; enabling a mixed acoustic signal received through a microphone of the electronic device to be converted into a mixed audio signal, the mixed acoustic signal comprising an echo of the acoustic signal played and an acoustic signal from a user; acquiring an echo reference signal, the echo reference signal being generated by converting the analog audio signal into a digital signal; and canceling an echo component from the mixed audio signal using the echo reference signal to obtain a user audio signal corresponding to the acoustic signal from the user.

The present disclosure provides a computation device. The computation device includes one or more processors and a storage device. The storage device is configured to store one or more programs. When the one or more programs are executed by the one or more processors, the one or more processors are configured to execute the method according to the second aspect of the present disclosure.

The present disclosure provides a computer readable storage medium. The computer readable storage medium has computer programs stored thereon. When the computer programs are executed by a processor, the method according to the second aspect of the present disclosure is executed.

BRIEF DESCRIPTION OF THE DRAWINGS

The above and additional aspects and advantages of embodiments of the present disclosure will become apparent and more readily appreciated from the following descriptions made with reference to the drawings. In the drawings, several embodiments of the present disclosure are illustrated in an example way instead of a limitation way, in which.

Throughout the drawings, same or similar reference numerals are used to indicate same or similar components.

DETAILED DESCRIPTION

Principles and spirit of the present disclosure will be described below with reference to several exemplary embodiments illustrated in the accompanying drawings. It is to be understood, the specific embodiments described herein are used to make the skilled in the art to understand well the present disclosure, and are not intended to limit the scope of the disclosure in any way.

In related arts, without an echo cancellation, a smart speaker is unable to recognize a superposition, collected by a microphone array of the smart speaker, of sound played by the smart speaker and sound provided by a user. A purpose of the echo cancellation is to remove the sound played in a mixed sound while preserving the user's voice.

Thus, an echo cancellation technology is one of essential technologies for voice interaction. How to better improve performance of the echo cancellation, so as to enhance experience of the voice interaction is one of current topics of speech-recognition-related technologies. However, performance of existing echo cancellation techniques does not enable good voice interaction in many situations.

As mentioned above, echo cancellation is one of essential technologies for performing a voice interaction. How to better improve performance of the echo cancellation to improve experience of the voice interaction is one of current topics of voice-recognition-related technologies. There are two technical solutions of echo cancellation. One is a pure software echo cancellation algorithm, which is mainly applied to communication software applications. The other one is a combination of extracting a reference signal via hardware and software echo algorithm to cancel echoes, which is widely applied now.

Figure 1:
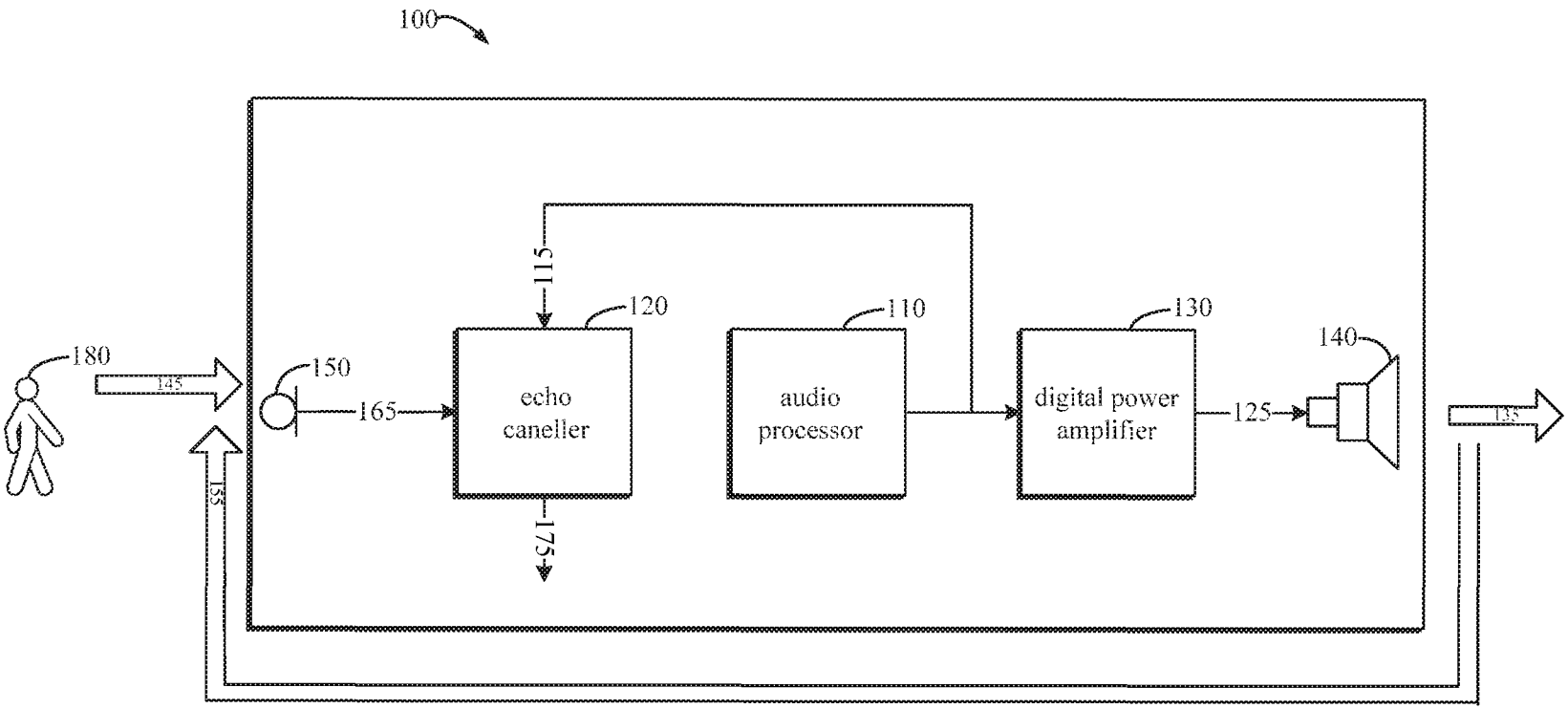
FIG. 1 is a schematic diagram illustrating a conventional device having an echo cancellation function according to an embodiment of the present disclosure.

FIG. 1 is a block diagram illustrating a conventional device 100 with an echo cancellation function. The device 100 may use the reference signal extracted by hardware in combination with software echo algorithm to perform the echo cancellation. As illustrated in FIG. 1, the device 100 includes an audio processor 110, which is configured to output a digital audio signal 115 to a digital power amplifier 130. The digital power amplifier 130 may amplify the digital audio signal 115 and performs a digital-to-analog conversion and to output an analog audio signal 125 to a loudspeaker 140. The analog audio signal 125 may drive the loudspeaker 140 to play an acoustic signal 135. The acoustic signal 135 may have various forms. For example, in a case that the device 100 is a smart sound box, the acoustic signal 135 may be sound played by the device 100, such as music or songs.

In addition, a user 180 may provide an acoustic signal (such as a voice) 145 to a microphone 150 of the device 100 to perform voice interaction with the device 100, such that the device 100 is controlled in voice. However, since the device 100 also provides the acoustic signal 135 and the acoustic signal 135 may be received by the microphone 150 via various spreading manners, an echo 155 is generated. Therefore, the microphone 150 actually receives a mixed acoustic signal. The mixed acoustic signal includes the acoustic signal 145 from the user 180 and the echo 155 of the acoustic signal 135. Further, the microphone 150 may convert the mixed acoustic signal into a mixed audio signal 165.

In the conventional solution illustrated as FIG. 1, in order to cancel an echo component from the mixed audio signal 165, the mixed audio signal 165 is provided to an echo canceller 120 of the device 100 to realize the echo cancellation. In order to perform the echo cancellation, the digital audio signal 115 outputted by the audio processor 110 is taken by the device 100 as an echo cancellation reference signal, which is used to cancel the echo component from the mixed audio signal 165. After performing the echo cancellation, the echo canceller 120 may obtain an audio signal 175 corresponding to the acoustic signal 145 from the user 180.

Further, the device 100 may recognize a voice control command sent from the user 180 by performing the voice recognition on the audio signal 175. The device 100 performs a corresponding operation according to the voice control command, to realize the voice interface with the user 180. For example, in a case that the device 100 is the smart sound box, the control command related to the acoustic signal 145 from the user 180 may include, but not limited to: playing, pausing, forward playing, backward playing, next one, pervious one, volume up, volume down, muting, shutting down or the like.

The inventor notices that, performance of the echo cancellation greatly relies on collection of the echo reference signals. On one hand, a solution to realize the echo cancellation using pure software algorithms does not extract an audio signal approximating a voice played by the loudspeaker. As a result, this echo cancellation algorithm is unable to perform the echo cancellation well. On the other hand, in the solution of combining hardware with software algorithms illustrated in FIG. 1, the echo reference signal 115 is generally collected from the audio processor 110 (for example, from an output interface I2S). However, for the device 100 for processing voice effects using the digital power amplifier 130, since the digital power amplifier 130 performs related processes on the voice effects, the echo reference signal 115 is significantly different from the acoustic signal 135 actually played by the loudspeaker 140. Therefore, performance of the echo cancellation is limited.

In order to solve the above problem and potential other related problems, embodiments of the present disclosure provide an improved echo cancellation technical solution. According to embodiments of the present disclosure, by improving a process of collecting the echo reference signals, the echo reference signal obtained by the electronic device for performing the echo cancellation approximates the audio signal of the voice played by the loudspeaker as possible, thereby improving an echo cancellation effect. Embodiments of the present disclosure will be described in detail in combination with FIGS. 2 to 5.

Figure 2:
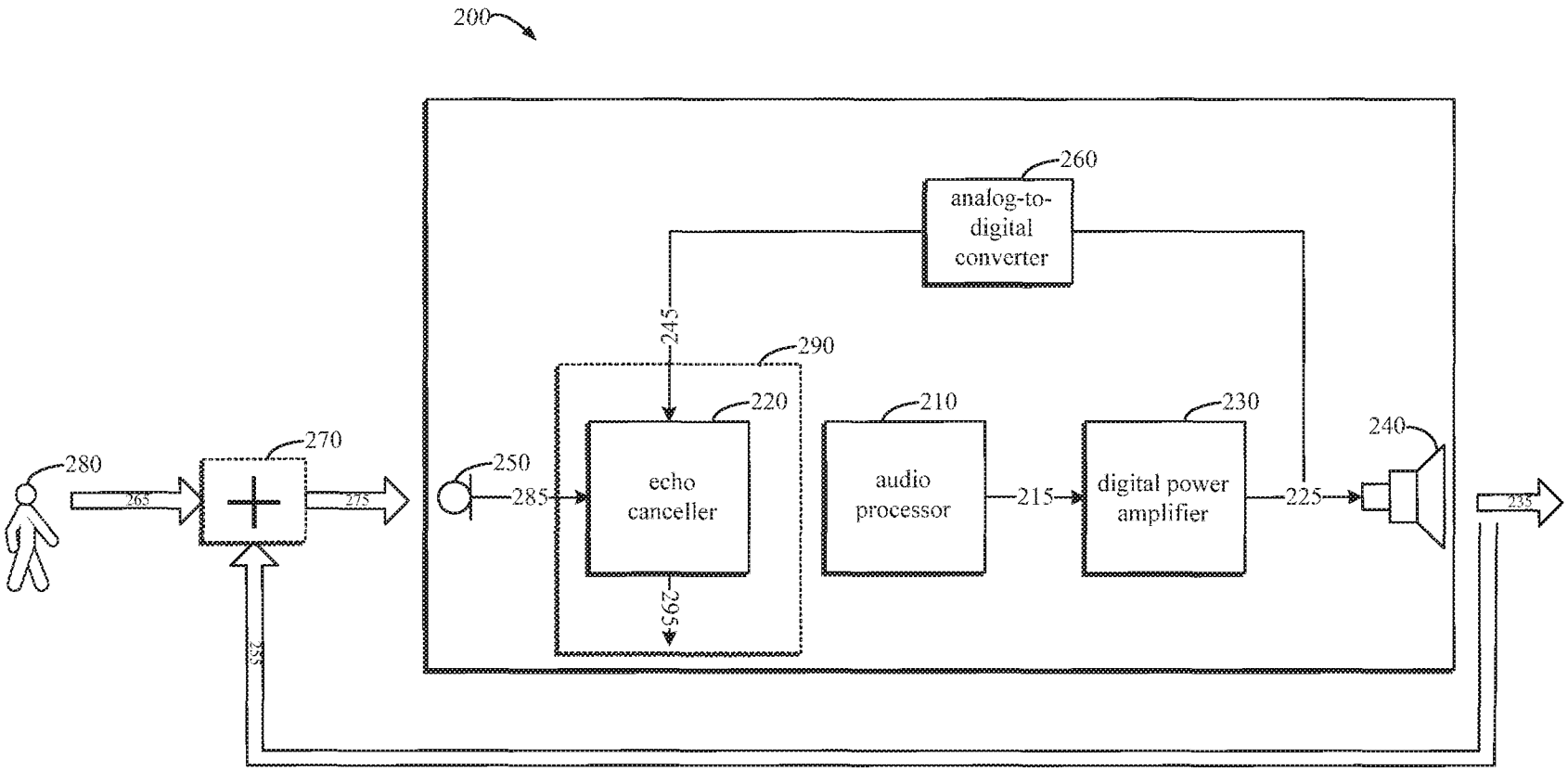
FIG. 2 is a block diagram illustrating an electronic device according to embodiments the present disclosure.

FIG. 2 is a block diagram illustrating an electronic device 200 according to embodiments of the present disclosure. It should be understood that, each component and unit of the electronic device 200 illustrated in FIG. 2 is given by examples only, which does not limit a scope of the present disclosure. Without departing from the scope of embodiments of the present disclosure, the component and unit illustrated in FIG. 2 may be added, removed or modified.

As illustrated in FIG. 2, the electronic device 200 includes a loudspeaker 240. The loudspeaker 240 is configured to play an acoustic signal 235 corresponding to an analog audio signal 225. For example, in an embodiment where the electronic device 200 is a smart sound box, the acoustic signal 235 may be music or songs played by the electronic device 200. The analog audio signal 225 may be a driving signal related to the music and songs and for driving the loudspeaker 240 to play.

In some embodiments, in order to obtain the acoustic signal 235 to be played, the electronic device 200 may include an audio processor 210 and a digital power amplifier 230. The audio processor 210 is configured to generate a digital audio signal 215 related to the acoustic signal 235. The digital power amplifier 210 is configured to amplify power of the digital audio signal 215 to obtain a power-amplified digital audio signal 215, and to generate the analog audio signal 225 based on the power-amplified digital audio signal 215, so as to drive the loudspeaker 240 to play the acoustic signal 235 corresponding to the analog audio signal 225. The analog audio signal 225 suffers from the analog-to-digital conversion and to be provided to the echo canceller 220 for the echo cancellation process.

The user 280 may provide an acoustic signal 265 to the electronic device 200 to perform the voice interaction with the electronic device 200. In order to receive the acoustic signal 265 sent from the user 280, the electronic device 200 further includes a microphone 250. As discussed above, since the electronic device 200 plays the acoustic signal 235, the microphone 250 actually receives a mixed acoustic signal 275. The mixed acoustic signal 2725 includes an echo 255 of the acoustic signal 235 played by the electronic device 200 and further includes the acoustic signal 265 from the user. A mixture process of these two acoustic signals 255 and 265 may be illustrated in FIG. 2 through a virtual adder 270. Under this case, the microphone 250 is configured to convert the mixed acoustic signal 275 received into a mixed audio signal 285. The electronic device 200 performs an echo cancellation on the mixed audio signal 285 through the echo canceller 220, to obtain a user audio signal 295 corresponding to the acoustic signal 265 from the user 280.

In some embodiments, the microphone 250 may be a single microphone. Alternatively, in other embodiments, the microphone 250 may also be realized by a microphone array. The microphone array is advantageous in some cases. For example, the user 280 is far away from the microphone 250 and there are a large amount of noises, multipath reflection and reverberations in a real environment. In the above cases, the microphone array may pick voice information better, thereby improving a rate of voice recognition.

In order to provide an echo reference signal 245 used for the echo cancellation to the echo canceller 220, the electronic device 200 further includes an analog-to-digital converter 260. The analog-to-digital converter 260 is configured to convert the analog audio signal 225 into a digital signal as the echo reference signal 245. On the basis of the echo reference signal 245, the echo canceller 220 may perform the echo cancellation on the mixed audio signal 285. In this way, the electronic device 200 is configured to convert the analog audio signal 225 inputted into the loudspeaker 240 into a digital echo reference signal 245 through the analog-to-digital converter 260. Therefore, the echo reference signal 245 approximating the acoustic signal played by the loudspeaker 240 may be provided, thereby improving an echo cancellation effect of the electronic device 200.

In some embodiments, in order to perform an echo cancellation on the mixed audio signal 285, the echo canceller 220 of the electronic device 200 is configured to cancel an echo component from the mixed audio signal 285 using the echo reference signal 245, to obtain the user audio signal 295 corresponding to the acoustic signal 265 sent from the user 280. In some embodiments, the echo canceller 220 may be implemented at a main processor 290 of the electronic device 200. In an alternative embodiment, the echo canceller 220 may further be implemented at an audio codec of the electronic device 200. An example that the echo canceller 220 is configured to perform the echo cancellation will be described in detail in combination with FIG. 3.

Figure 3:
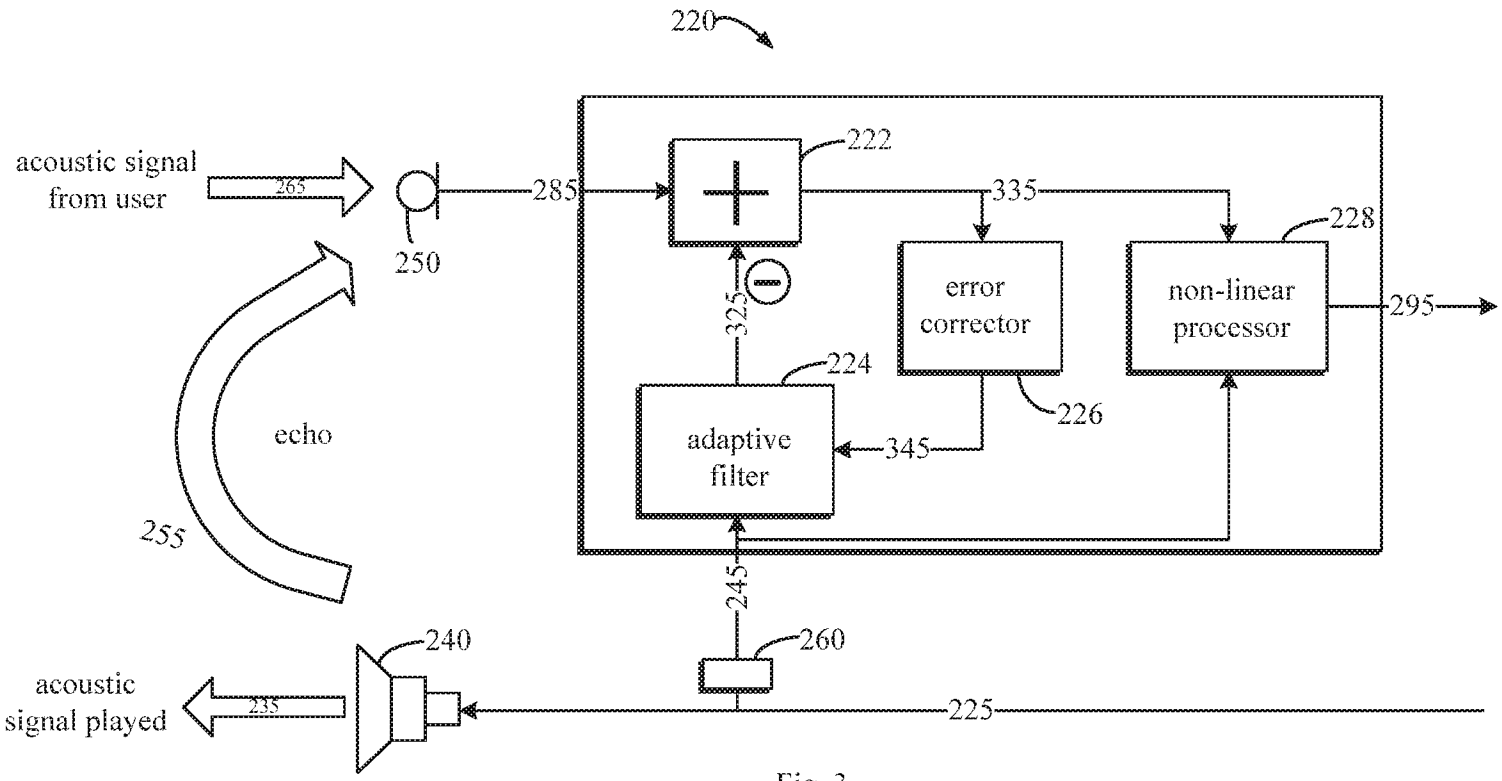
FIG. 3 is a schematic diagram illustrating an echo canceller according to embodiments of the present disclosure.

FIG. 3 is a block diagram illustrating an echo canceller 220 according to embodiments of the present disclosure. As illustrated in FIG. 3, the echo canceller 220 may include an adder 222, an adaptive filter 224, an error corrector 226 and a non-linear processor 228. In addition, same reference numerals in FIG. 3 with those in FIG. 2 are used to indicate same components or signals. Descriptions of these components or signals may be referred to descriptions made to FIG. 2, which are not elaborated herein.

In order to play the acoustic signal 235 for the user 280, the analog audio signal 225 is inputted to the loudspeaker 240, so as to drive the loudspeaker 240 to play the acoustic signal 235. In addition, as described above, the analog-to-digital converter 260 is configured to convert the analog audio signal 225 into a digital signal as the echo reference signal 245 to be inputted into the echo canceller 220.

In a case that the user 280 inputs a voice to the electronic device 200, the acoustic signal 265 of the user 280 and the echo 255 of the acoustic signal 235 of the electronic device 200 are inputted into the microphone 250 together to generate the mixed audio signal 285. The mixed audio signal 285 is inputted into the echo canceller 220 for the echo cancellation. Specifically, when performing the echo cancellation, the echo canceller 220 may perform a linear adaptive filtering process based on the echo reference signal 245 through the adaptive filter 224.

For example, the echo canceller 220 may be configured to establish a far-end echo voice model based on the echo reference signal 245, and to perform an adaptive filtering on the mixed audio signal 285 based on the voice model through the adapter filter 224, such that the echo component is cancelled from the mixed audio signal 285. As an example, the echo canceller 220 may be configured to subtract an output 325 of the adaptive filter 224 from the mixed audio signal 285 through the adder 222, to obtain the audio signal 335 suffered from the linear adaptive filtering. In some embodiments, the audio signal 235 may be directly outputted as the user audio signal 295. In addition, the error corrector 226 may be configured to generate an error correction signal 345 based on the audio signal 335. The error correction signal 345 is inputted to the adaptive filter 224 to adjust parameters of the adaptive filter. In this manner, since the echo reference signal 245 approximates the acoustic signal played by the loudspeaker 240, the far-end echo voice model may be accurately established, thereby improving an effect of adaptive filtering.

In some alternative embodiments, the echo canceller 220 may be further configured to perform a non-linear processing on the audio signal 335 based on the echo reference signal 245 through the non-linear processor 228. FIG. 3 illustrates an embodiment of the non-linear processing. The non-liner processing may include a residual echo cancellation processing and a non-linear cutting processing. For example, the residual echo cancellation processing refers to that the echo cancellation is performed during a second round on residual echoes of the audio signal 335 suffered from the linear echo cancellation during a first round. Through the residual echo cancellation, the echo component may be further removed from the audio signal 335, thereby obtaining the user audio signal 295 more accurately and effectively.

In the non-linear cutting processing, the echo canceller 220 may be configured to determine a portion of the audio signal 335 whose attenuation amount reaches a threshold attenuation amount. In this case, the echo canceller 220 may be configured to perform the cutting processing on the portion through the non-linear processor 228. In this way, the user audio signal 295 may be obtained more accurately and more effectively.

Return to FIG. 2, the electronic device 200 may further include a voice recognizer (not shown). The voice recognizer may be configured to recognize a control command from the user 280 based on the user audio signal 295. Since the user audio signal 295 is generated based on the echo reference signal 245 approximating the acoustic signal played by the loudspeaker 240, the user audio signal 295 may be obtained to have a better quality. Therefore, the electronic device 200 may recognize the control command from the user 280 more accurately and more effectively. In some embodiments, the electronic device 200 may be a smart sound box. The electronic device 20 may be configured to execute following operations based on the control command from the user 280: playing, pausing, forward playing, backward playing, next one, pervious one, volume up, volume down, muting, shutting down or the like.

In some embodiments, in order to facilitate the recognition of the control command from the user 280 by the electronic device 200, the electronic device 200 may further include one or more components for processing the user audio signal 295, such as a beam-former, a noise reducer, a sound source locator and a signal amplifier (not shown). The beam-former may be configured to perform a beam-forming operation on the user audio signal 295 to realize a directional reception of the acoustic signal 265 of the user 280 by the microphone 250. The noise reducer may be configured to perform a noise reduction operation on the user audio signal 295 to reduce interference of the noises on the voice recognition. The sound source locator may be configured to perform a sound source location operation on the user audio signal 295 to improve a targeted reception of the acoustic signal 265 of the user 280 by the microphone 250. The signal amplifier may be configured to perform a signal amplification process on the user audio signal 295, to improve identifiability of the user audio signal 295. With those optimization operations, a probability that the electronic device 200 recognizes the control command provided by the user 280 may be improved.

It will be understood that, the electronic device 200 may include various smart home appliances, smart on-vehicle devices, robots or fixed or portable electronic devices having a voice interaction function. A specific example of the electronic device 200 may include, but not limited to, a smart sound box, a smart television, a smart refrigerator, a smart washer, a smart cooker, a smart air-conditioner, a smart electric water heater, a smart set top box, a smart on-vehicle sound box, a smart on-vehicle navigation device, a cleaning robot, a chatting robot, a nursing robot, or the like.

With embodiments of the present disclosure, performance of the echo cancellation of the electronic device 200 having the voice interaction function may be improved. Therefore, the recognition of the voice control command provided by the user by the electronic device 200 may be improved and user experience of the voice interaction between the user 280 and the electronic device 200 may be improved.

Figure 4:
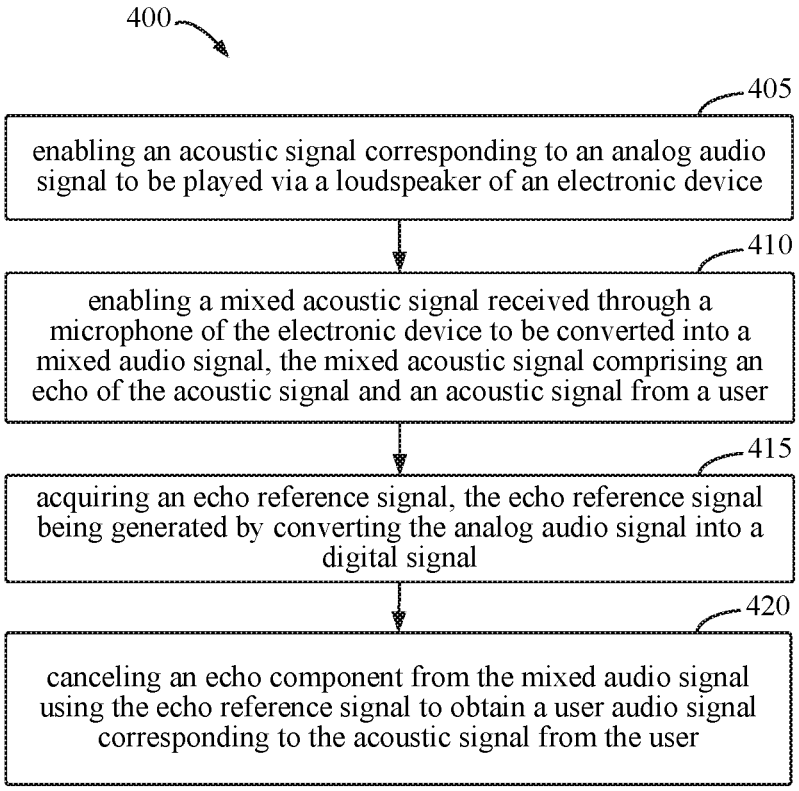
FIG. 4 is a flow chart illustrating a method for cancelling an echo according to embodiments of the present disclosure.

FIG. 4 is a flow chart illustrating a method 400 for cancelling an echo implemented at the electronic device 200 according to embodiments of the present disclosure. The method 400 may be implemented at a processor 290 or at an audio codec of the electronic device 200. Alternatively, in some embodiments, the method 400 may also be implemented at an echo canceller 220. To simplify discussion, the method 400 may be discussed in combination with the main processor 290 of the electronic device 200 illustrated in FIG. 2.

At block 405, the main processor 290 is configured to enable an acoustic signal 235 corresponding to an analog audio signal 225 to be played via a loudspeaker 240 of the electronic device 200. For example, the main processor 290 may enable the loudspeaker 240 to play the acoustic signal 235. In an embodiment where the electronic device 200 is a smart sound box, the acoustic signal 235 may be music or songs played by the electronic device 200, while the analog audio signal 225 may be a driving signal related to the music or songs and used for driving the loudspeaker 240 to play music or a song.

In some embodiments, in order to provide the analog audio signal 225 to the loudspeaker 240, the main processor 290 may enable an audio generator 210 to generate a digital audio signal 215. In addition, the main processor 290 may enable a digital power amplifier 230 to amplify power of the digital audio signal 215 to obtain a power-amplified digital audio signal 215 and to generate the analog audio signal 225 based on the power-amplified digital audio signal 215.

At block 410, the main processor 290 is configured to enable a mixed acoustic signal 275 of a microphone 250 of the electronic device 200 to be converted into a mixed audio signal 285. The mixed acoustic signal 275 includes an echo 255 of the acoustic signal 235 played by the electronic device 200 and an acoustic signal 265 from the user 280. For example, in an embodiment where the electronic device 200 is a smart sound box, the acoustic signal 265 may be a voice control command provided by the user 280 to the electronic device 200. In some embodiments, the main processor 290 may be configured to enable the microphone 250 to receive a mixed acoustic signal 275. The microphone 250 may be one microphone included in a microphone array.

At block 415, the main processor 290 is configured to acquire an echo reference signal 245. The echo reference signal 245 is generated by converting the analog audio signal 225 into a digital signal. For example, the analog audio signal 225 may be taken from an output end of the digital power amplifier 230, or may be taken from an input end of the loudspeaker 240. In some embodiments, the main processor 290 may enable the analog-to-digital converter 260 to convert the analog audio signal 225 into a digital signal.

At block 420, the main processor 290 is configured to cancel an echo component from the mixed audio signal 285 using the echo reference signal 245, to obtain a user audio signal 295 corresponding to the acoustic signal 265 from the user 280. For example, the main processor 290 may be configured to enable the echo canceller 220 to perform the echo cancellation.

In order to cancel the echo component from the mixed audio signal 285 using the echo reference signal 245, the main processor 290 may be configured to establish a far-end echo voice model based on the echo reference signal 245 and to perform an adaptive filter on the mixed audio signal 285 based on the voice model, so as to cancel the echo component from the mixed audio signal 285. In addition, the main processor 290 may be further configured to perform a residual echo cancellation operation on the user audio signal 295. Further, the main processor 290 may be configured to determine a portion of the user audio signal 295 whose attenuation amount reaches a threshold attenuation amount and to perform a cutting operation on the portion.

In order to interact with the user 280, the main processor 290 may be configured to recognize a control command from the user 280 based on the user audio signal 295. The main processor 290 may be configured to control the electronic device 200 based on the control command, so as to realize to control the electronic device 200 by the user 280 through the acoustic signal 265. In addition, the main processor 290 may be configured to perform a beamforming operation, a noise reduction operation, a sound source location operation, a signal amplification operation on the user audio signal 295 to optimize the voice recognition of the user audio signal 295 by the electronic device 200.

Figure 5:
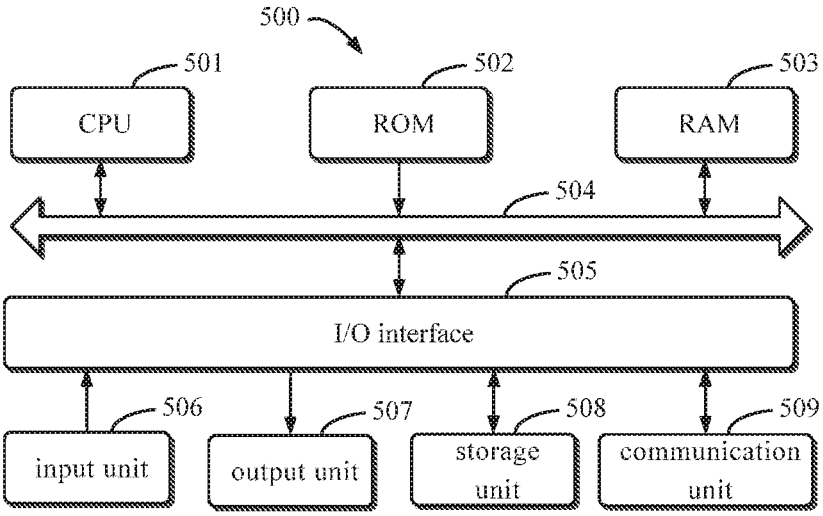
FIG. 5 is a block diagram illustrating a device adaptive to implement embodiments of the present disclosure.

FIG. 5 is a block diagram illustrating a device 500 that may be used for implementing embodiments of the present disclosure. As illustrated in FIG. 5, the device 500 includes a central processing unit (CPU) 501. The CPU 501 may be configured to execute various appreciate actions and processing according to computer program instructions stored in a read only memory (ROM) 502 or computer program instructions loaded from a storage unit 508 to a random access memory (RAM) 503. In the RAM 503, various programs and data required by the device 500 may be further stored. The CPU 501, the ROM 502 and the RAM 503 are connected to each other via a bus 504. An input/output (I/O) interface 505 is also connected to the bus 504.

Components of the device 500 are connected to the I/O interface 505, including an input unit 506, such as a keyboard, a mouse, etc.; an output unit 507, such as various types of displays, loudspeakers, etc.; a storage unit 508, such as a magnetic disk, a compact disk, etc.; and a communication unit 509, such as a network card, a modem, a wireless communication transceiver, etc. The communication unit 509 allows the device 500 to exchange information/data with other devices through a computer network, such as Internet, and/or various telecommunication networks.

The various procedures and processing described above, such as method 400, may be performed by the processing unit 501. For example, in some embodiments, the method 400 can be implemented as a computer software program that is tangibly enclosed in a machine readable medium, such as the storage unit 508. In some embodiments, some or all of the computer programs may be loaded and/or installed onto the device 500 via the ROM 502 and/or the communication unit 509. One or more blocks of the method 400 described above may be performed when a computer program is loaded into the RAM 503 and executed by the CPU 501.

As used herein, term "comprise" and its equivalents may be understood to be non-exclusive, i.e., "comprising but not limited to". Term "based on" should be understood to be "based at least in part on". Term "one embodiment" or "the embodiment" should be understood as "at least one embodiment." Terms "first," "second," and the like may refer to different or identical objects. This specification may also include other explicit and implicit definitions.

As used herein, term "determining" encompasses various actions. For example, "determining" can include operating, computing, processing, deriving, investigating, looking up (e.g., looking up in a table, database, or another data structure), ascertaining, and the like. Further, "determining" can include receiving (e.g., receiving information), accessing (e.g., accessing data in memory), and the like. Further, "determining" may include parsing, choosing, selecting, establishing, and the like.

It should be noted that embodiments of the present disclosure may be implemented via hardware, software, or a combination of software and hardware. The hardware can be implemented using dedicated logic; the software can be stored in memory and executed by a suitable instruction execution system, such as a microprocessor or dedicated design hardware. Those skilled in the art will appreciate that the apparatus and method described above can be implemented using computer-executable instructions and/or embodied in processor control codes. For example, a programmable memory or data carrier such as an optical or electronic signal carrier provide such codes In addition, although operations of the method of the present disclosure are described in a particular order in the drawings, it is not required or implied that the operations must be performed in the particular order, or that all of the illustrated operations must be performed to achieve the desired result. Instead, the order of steps depicted in flowcharts can be changed. Additionally or alternatively, some steps may be omitted, multiple steps may be combined into one step, and/or one step may be broken into multiple steps. It should also be noted that features and functions of two or more devices in accordance with the present disclosure may be embodied in one device. Conversely, features and functions of one device described above can be further divided into and embodied by multiple devices.

Although the present disclosure has been described with reference to several specific embodiments, it should be understood that the present disclosure is not limited to the specific embodiments disclosed. The present disclosure is intended to cover various modifications and equivalent arrangements within the spirit and scope of the appended claims.

What is claimed is:

1. An electronic device, comprising:

a loudspeaker, configured to play an acoustic signal corresponding to an analog audio signal;

a microphone, configured to convert a mixed acoustic signal received into a mixed audio signal; the mixed acoustic signal comprising an echo of the acoustic signal played and an acoustic signal from a user;

an analog-to-digital convertor, configured to convert the analog audio signal into a digital signal as an echo reference signal; and an echo canceller, configured to cancel an echo component from the mixed audio signal using the echo reference signal to obtain a user audio signal corresponding to the acoustic signal from the user;

wherein the echo canceller is further configured to determine a portion of the user audio signal, in which an attenuation amount of the portion of the user audio signal reaches a threshold attenuation amount and the attenuation amount is caused by a residual echo cancellation processing; and perform a cutting processing on the portion, as the user audio signal corresponding to the acoustic signal from the user.

2. The electronic device according to claim 1, further comprising:

an audio processor, configured to generate a digital audio signal; and a digital power amplifier, configured to:

amplify power of the digital audio signal to obtain a power-amplified digital audio signal; and generate the analog audio signal based on the power-amplified digital audio signal.

3. The electronic device according to claim 1, further comprising:

a voice recognizer, configured to recognize a control command from the user based on the user audio signal, to control the electronic device.

4. The electronic device according to claim 1, wherein the echo canceller is further configured to:

establish a far-end echo voice model based on the echo reference signal; and adaptively filter the mixed audio signal based on the voice model, to cancel the echo component from the mixed audio signal.

5. The electronic device according to claim 1, wherein the echo canceller is further configured to:

perform a residual echo cancellation process on the user audio signal.

6. The electronic device according to claim 1, wherein the echo canceller is realized at a main processor or an audio codec of the electronic device.

7. The electronic device according to claim 1, further comprising at least one of:

a beam former, configured to perform a beam forming process on the user audio signal;

a noise reducer, configured to perform a noise reduction process on the user audio signal;

a sound source locator, configured to perform a sound source location process on the user audio signal; and a signal amplifier, configured to perform a signal amplification process on the user audio signal.

8. The electronic device according to claim 1, wherein the electronic device comprises at least one of: a smart sound box, a smart home appliance, a smart on-vehicle device and a robot.

9. An echo cancellation method, comprising:

enabling an acoustic signal corresponding to an analog audio signal to be played via a loudspeaker of an electronic device;

enabling a mixed acoustic signal received through a microphone of the electronic device to be converted into a mixed audio signal, the mixed acoustic signal comprising an echo of the acoustic signal played and an acoustic signal from a user;

acquiring an echo reference signal, the echo reference signal being generated by converting the analog audio signal into a digital signal; and canceling an echo component from the mixed audio signal using the echo reference signal to obtain a user audio signal corresponding to the acoustic signal from the user;

wherein the method further comprises: determining a portion of the user audio signal, in which an attenuation amount of the portion of the user audio signal reaches a threshold attenuation amount and the attenuation amount is caused by a residual echo cancellation processing; and performing a cutting processing on the portion, as the user audio signal corresponding to the acoustic signal from the user.

10. The method according to claim 9, further comprising:

generating a digital audio signal;

amplifying power of the digital audio signal to obtain a power-amplified digital audio signal; and generating the analog audio signal based on the power-amplified digital audio signal.

11. The method according to claim 9, further comprising:

recognizing a control command from the user based on the user audio signal, to control the electronic device.

12. The method according to claim 9, wherein canceling the echo component from the mixed audio signal using the echo reference signal comprises:

establishing a far-end echo voice mode based on the echo reference signal; and adaptively filtering the mixed audio signal based on the voice mode, to cancel the echo component from the mixed audio signal.

13. The method according to claim 9, further comprising:

performing a residual echo cancellation process on the user audio signal.

14. The method according to claim 9, further comprising at least one of:

performing a beam forming process on the user audio signal;

performing a noise reduction process on the user audio signal;

performing a sound source location process on the user audio signal; and performing a signal amplification process on the user audio signal.

15. The method according to claim 9, wherein the electronic device includes at least one of: a smart sound box, a smart home appliance, a smart on-vehicle device and a robot.

16. A non-transitory computer readable storage medium, having computer programs stored thereon, wherein when the computer programs are executed by a processor, an echo cancellation method is executed, the echo cancellation method comprises:

enabling an acoustic signal corresponding to an analog audio signal to be played via a loudspeaker of an electronic device;

enabling a mixed acoustic signal received through a microphone of the electronic device to be converted into a mixed audio signal, the mixed acoustic signal comprising an echo of the acoustic signal played and an acoustic signal from a user;

acquiring an echo reference signal, the echo reference signal being generated by converting the analog audio signal into a digital signal; and canceling an echo component from the mixed audio signal using the echo reference signal to obtain a user audio signal corresponding to the acoustic signal from the user, wherein the method further comprises: determining a portion of the user audio signal, in which an attenuation amount of the portion of the user audio signal reaches a threshold attenuation amount and the attenuation amount is caused by a residual echo cancellation process; and performing a cutting process on the portion, as the user audio signal corresponding to the acoustic signal from the user.

17. The non-transitory computer readable storage medium according to claim 16, wherein the echo cancellation method further comprises:

generating a digital audio signal;

amplifying power of the digital audio signal to obtain a power-amplified digital audio signal; and generating the analog audio signal based on the power-amplified digital audio signal.

18. The non-transitory computer readable storage medium according to claim 16, wherein the echo cancellation method further comprises:

recognizing a control command from the user based on the user audio signal, to control the electronic device.

* * * * *